US009431729B2

(12) United States Patent
Kondo

(10) Patent No.: US 9,431,729 B2
(45) Date of Patent: Aug. 30, 2016

(54) CONTACT, CONNECTOR AND METHOD FOR MANUFACTURING CONNECTOR

(71) Applicant: FUJITSU COMPONENT LIMITED, Tokyo (JP)

(72) Inventor: Takahiro Kondo, Tokyo (JP)

(73) Assignee: FUJITSU COMPONENT LIMITED, Tokyo (JP)

( * ) Notice: Subject to any disclaimer, the term of this patent is extended or adjusted under 35 U.S.C. 154(b) by 92 days.

(21) Appl. No.: 13/749,239

(22) Filed: Jan. 24, 2013

(65) Prior Publication Data

US 2013/0244482 A1 Sep. 19, 2013

(30) Foreign Application Priority Data

Mar. 19, 2012 (JP) ..... 2012-061634

(51) Int. Cl.

| | |
|---|---|
| ***H01R 9/05*** | (2006.01) |
| ***H01R 43/16*** | (2006.01) |
| ***H01R 9/03*** | (2006.01) |
| *H01R 13/6471* | (2011.01) |

(52) U.S. Cl.

CPC ..... *H01R 9/0512* (2013.01); *H01R 9/034* (2013.01); *H01R 43/16* (2013.01); *H01R 13/6471* (2013.01); *Y10T 29/49204* (2015.01)

(58) Field of Classification Search

CPC H01R 13/648; H01R 9/034; H01R 13/6471; H01R 9/0512; Y10T 29/49204

USPC ..... 439/578, 952, 607.41, 607, 212, 579, 439/98, 99, 497, 607.48, 108

See application file for complete search history.

(56) References Cited

U.S. PATENT DOCUMENTS

| | | | | |
|---|---|---|---|---|
| 3,513,433 | A * | 5/1970 | Carroll | 439/579 |
| 4,365,856 | A * | 12/1982 | Yaegashi | H01R 12/775 439/402 |
| 4,464,003 | A * | 8/1984 | Goodman et al. | 439/404 |
| 4,624,515 | A * | 11/1986 | Brush et al. | 439/95 |
| 4,767,345 | A * | 8/1988 | Gutter | H01R 13/514 439/497 |
| 4,875,877 | A * | 10/1989 | Fleak et al. | 439/497 |
| 5,030,138 | A * | 7/1991 | Capp et al. | 439/497 |
| 5,281,762 | A * | 1/1994 | Long | H01R 9/0515 174/117 F |
| 5,460,533 | A * | 10/1995 | Broeksteeg | H01R 13/6335 439/108 |
| 5,785,555 | A * | 7/1998 | O'Sullivan | H01R 9/0518 439/108 |

(Continued)

FOREIGN PATENT DOCUMENTS

| | | |
|---|---|---|
| JP | 4-61765 | 2/1992 |
| JP | 8-64314 | 3/1996 |

(Continued)

OTHER PUBLICATIONS

Patent Abstracts of Japan, Publication No. 2011-023319, Published Feb. 3, 2011.

(Continued)

*Primary Examiner* — Neil Abrams
*Assistant Examiner* — Travis Chambers
(74) *Attorney, Agent, or Firm* — Staas & Halsey LLP

(57) ABSTRACT

A contact includes: a cable connection portion that is connected to a signal line in an exterior cable; a fixed portion that is extended toward a front edge of the contact from the cable connection portion, and fixed to an exterior connector cover; and a connector connection portion that is extended toward the front edge of the contact from the fixed portion, and connected to a conductor of an exterior connector.

9 Claims, 20 Drawing Sheets

(56) References Cited

U.S. PATENT DOCUMENTS

| | | | | |
|---|---|---|---|---|
| 5,823,825 | A * | 10/1998 | Murphy | H01R 9/038 439/607.5 |
| 5,961,348 | A * | 10/1999 | Murphy | H01R 4/023 439/108 |
| 5,964,620 | A * | 10/1999 | Takahashi | H01R 9/0518 439/579 |
| 6,031,185 | A * | 2/2000 | Bouveret et al. | 174/84 R |
| 6,139,364 | A * | 10/2000 | Beutler et al. | 439/607.01 |
| 6,186,828 | B1 * | 2/2001 | O'Sullivan | H01R 9/0518 439/579 |
| 6,210,230 | B1 * | 4/2001 | Lai | H01R 9/0518 439/101 |
| 6,241,200 | B1 * | 6/2001 | Camporeale | F16L 3/223 248/497 |
| 6,489,563 | B1 * | 12/2002 | Zhao et al. | 174/88 C |
| 6,554,644 | B2 * | 4/2003 | Koide | 439/585 |
| 6,722,898 | B2 * | 4/2004 | Peloza et al. | 439/108 |
| 6,951,477 | B2 * | 10/2005 | Tondreault et al. | 439/497 |
| 6,951,479 | B1 * | 10/2005 | Wu | 439/541.5 |
| 7,052,292 | B2 * | 5/2006 | Hsu et al. | 439/98 |
| 7,214,097 | B1 * | 5/2007 | Hsu | H01R 13/65802 439/607.47 |
| 7,470,150 | B2 * | 12/2008 | Kuo et al. | 439/607.41 |
| 7,497,724 | B1 * | 3/2009 | Fong | H01R 4/023 439/497 |
| 7,819,675 | B2 * | 10/2010 | Ko et al. | 439/98 |
| 8,011,950 | B2 * | 9/2011 | McGrath et al. | 439/497 |
| 8,298,009 | B2 * | 10/2012 | Elkhatib et al. | 439/581 |
| 8,337,243 | B2 * | 12/2012 | Elkhatib et al. | 439/581 |
| 8,911,254 | B2 * | 12/2014 | Montena | H01R 9/032 439/579 |
| 8,956,167 | B2 * | 2/2015 | Wu | H01R 13/40 439/497 |
| 2002/0132534 | A1 * | 9/2002 | Serbin et al. | 439/877 |
| 2008/0124972 | A1 * | 5/2008 | Kobayashi et al. | 439/585 |

FOREIGN PATENT DOCUMENTS

| | | |
|---|---|---|
| JP | 10-223269 | 8/1998 |
| JP | 3069472 | 3/2000 |
| JP | 2011-23319 | 2/2011 |

OTHER PUBLICATIONS

Patent Abstracts of Japan, Publication No. 10-223269, Published Aug. 21, 1998.

J Plat-Pat English Abstract of Japanese Publication No. 4-61765, published Feb. 27, 1992.

J Plat-Pat English Abstract of Japanese Publication No. 8-64314, published Mar. 8, 1996.

Japanese Office Action dated Jun. 21, 2016 in corresponding Japanese Patent Application No. 2012-274027.

* cited by examiner

CONTACT, CONNECTOR AND METHOD FOR MANUFACTURING CONNECTOR

CROSS-REFERENCE TO RELATED APPLICATION

This application is based upon and claims the benefit of priority of the prior Japanese Patent Application No. 2012-061634, filed on Mar. 19, 2012, the entire contents of which are incorporated herein by reference.

FIELD

A certain aspect of the embodiments discussed herein is related to a contact, a connector and a method for manufacturing a connector.

BACKGROUND

A coaxial cable is widely used as a connection for various electric circuits. In the coaxial cable, a central conductor (i.e., a core wire or a signal line) that conducts a signal, and an outer conductor (i.e., a braided shield part) to which a ground potential is given are provided concentrically. In Patent Document 1 (see Japanese Laid-Open Patent Application No. 2011-23319), the central conductor and the outer conductor are soldered to a tabular conductor provided on the surface of a substrate, so that the substrate is constituted as a harness. With respect to a connection method of the coaxial cable, a method for inserting the harness into a receptacle of a connector is disclosed in Patent Document 1.

A technique concerning a contact and a connector that are connectable to the coaxial cable is disclosed in Patent Document 2 (see Japanese Registered Utility Model No. 3069472) and Patent Document 3 (see Japanese Laid-Open Patent Application No. 10-223269)

SUMMARY

According to an aspect of the present invention, there is provided a contact including: a cable connection portion that is connected to a signal line in an exterior cable; a fixed portion that is extended toward a front edge of the contact from the cable connection portion, and fixed to an exterior connector cover; and a connector connection portion that is extended toward the front edge of the contact from the fixed portion, and connected to a conductor of an exterior connector.

The objects and advantages of the invention will be realized and attained by the elements and combinations particularly pointed out in the claims.

It is to be understood that both the foregoing general description and the following detailed description are exemplary and explanatory and are not restrictive of the invention, as claimed.

BRIEF DESCRIPTION OF DRAWINGS

DETAILED DESCRIPTION (First Embodiment) FIG. 1 is an exploded perspective view of a connector according to a first embodiment. The connector includes first contacts 1, a second contact 2 and a connector cover 3. Here, coaxial cables 4 to be connected to the connector are also illustrated in FIG. 1.

Figure 1:
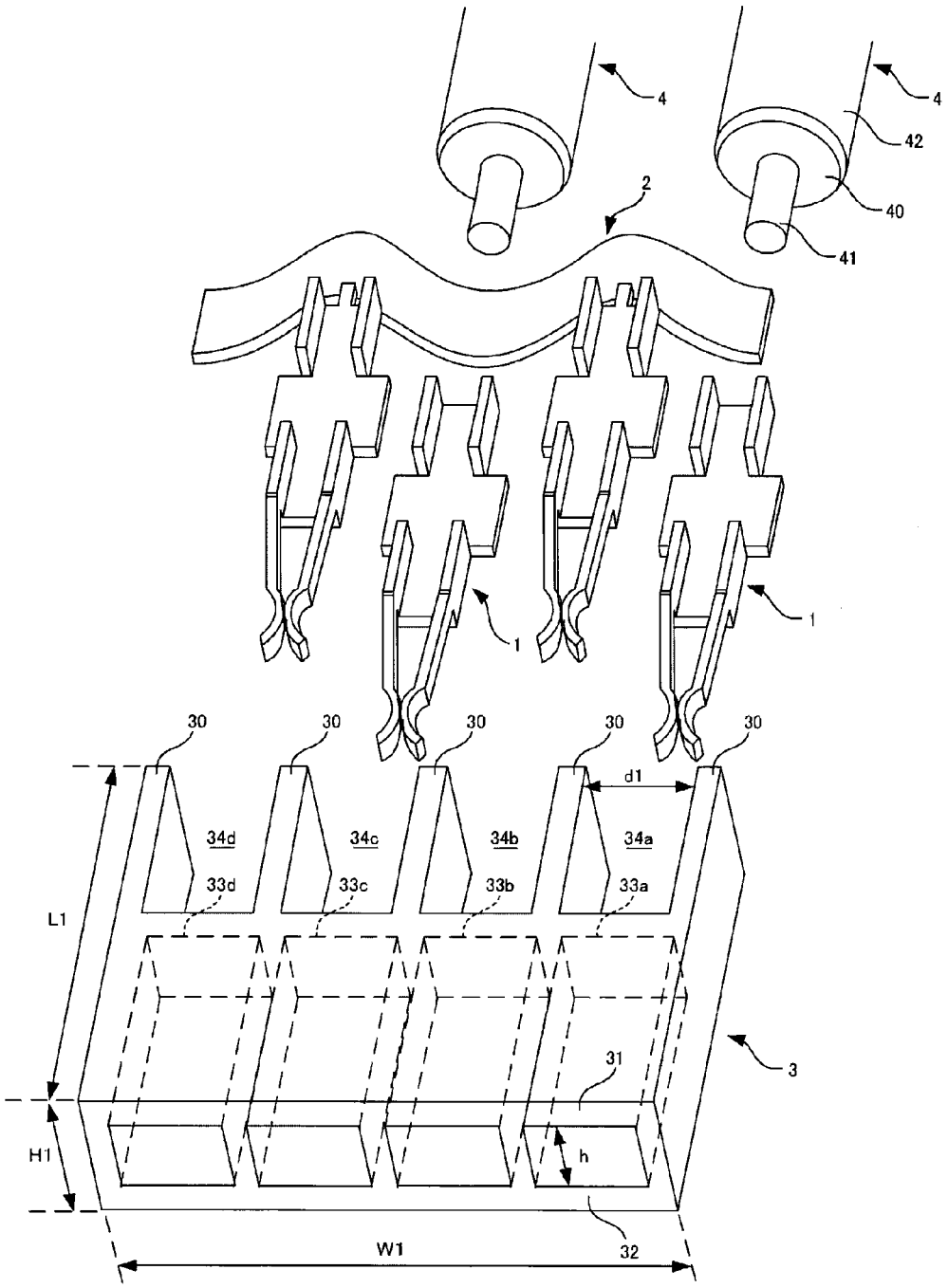
FIG. 1 is an exploded perspective view of a connector according to a first embodiment.

The connector of the present embodiment is connected to the two coaxial cables 4. Each of the coaxial cables 4 includes a core wire 41 that is a central conductor, an insulator 40 that covers the periphery of the core wire 41, and an outer peripheral shield part 42 that covers the periphery of the insulator 40 as an outer conductor. The core wire 41, the insulator 40 and the outer peripheral shield part 42 are concentrically formed as viewed from a cross-section surface of the coaxial cable 4. The core wire 41 functions as a signal line transmitting a signal.

In the coaxial cable 4, a signal is transmitted to the core wire 41, for example. On the contrary, a ground potential (GND) is given to the outer peripheral shield part 42, and a characteristic impedance is set as 50 (Ω) or 75 (Ω). There is no limitation in the material and the size of the coaxial cable 4.

The connector cover 3 is an insulating member for holding and covering the first contacts 1 and the second contact 2 as a housing, and is obtained by carrying out injection molding of an elastic plastic, for example. The connector cover 3 has a shape in which four cut edge parts 34*a* to 34*d* arranged in a width direction and through-holes 33*a* to 33*d* are provided on a rectangular parallelepiped indicated by a width W1×a length L1×a height H1. The cut edge parts 34*a* to 34*d* are spaces in the shape of the rectangular parallelepiped which exist between five wall parts 30 arranged in the width direction, respectively. The wall parts 30 are mutually opposed so as to be spaced by an interval d1 in the width direction.

Each of the through-holes 33*a* to 33*d* is a rectangular parallelepiped-like space which is surrounded with a pair of the wall parts 30, a top board part 31 and a bottom board part 32, and the through-holes 33*a* to 33*d* are coupled to the cut edge parts 34*a* to 34*d*, respectively. The top board part 31 and the bottom board part 32 are spaced by an interval h and are opposed to each other in a height direction. The through-holes 33*a* to 33*d* and the corresponding cut edge parts 34*a* to 34*d* are arranged so as to be spaced by a constant pitch. For example, the width W1, the length L1, the height H1, the interval d1 and the interval h are 5.08 mm, 3mm, 1.27mm, 0.9 mm and 0.8 mm, respectively.

Each of the first contacts 1 and the second contact 2 is a member that electrically connects a connection object of the connector to the coaxial cable 4, and is made of a conductive component, such as copper. The first contacts 1 are connected to the core wires 41 of the coaxial cables 4, and are inserted into the through-holes 33*a* and 33*c* via the cut edge parts 34*a* and 34*c*. The second contact 2 is connected to the outer peripheral shield part 42 of the coaxial cable 4. The second contact 2 includes the two same members as the first contacts 1, and the two members are inserted into the through-holes 33*b* and 33*d* via the cut edge parts 34*b* and 34*d*.

Figure 2:
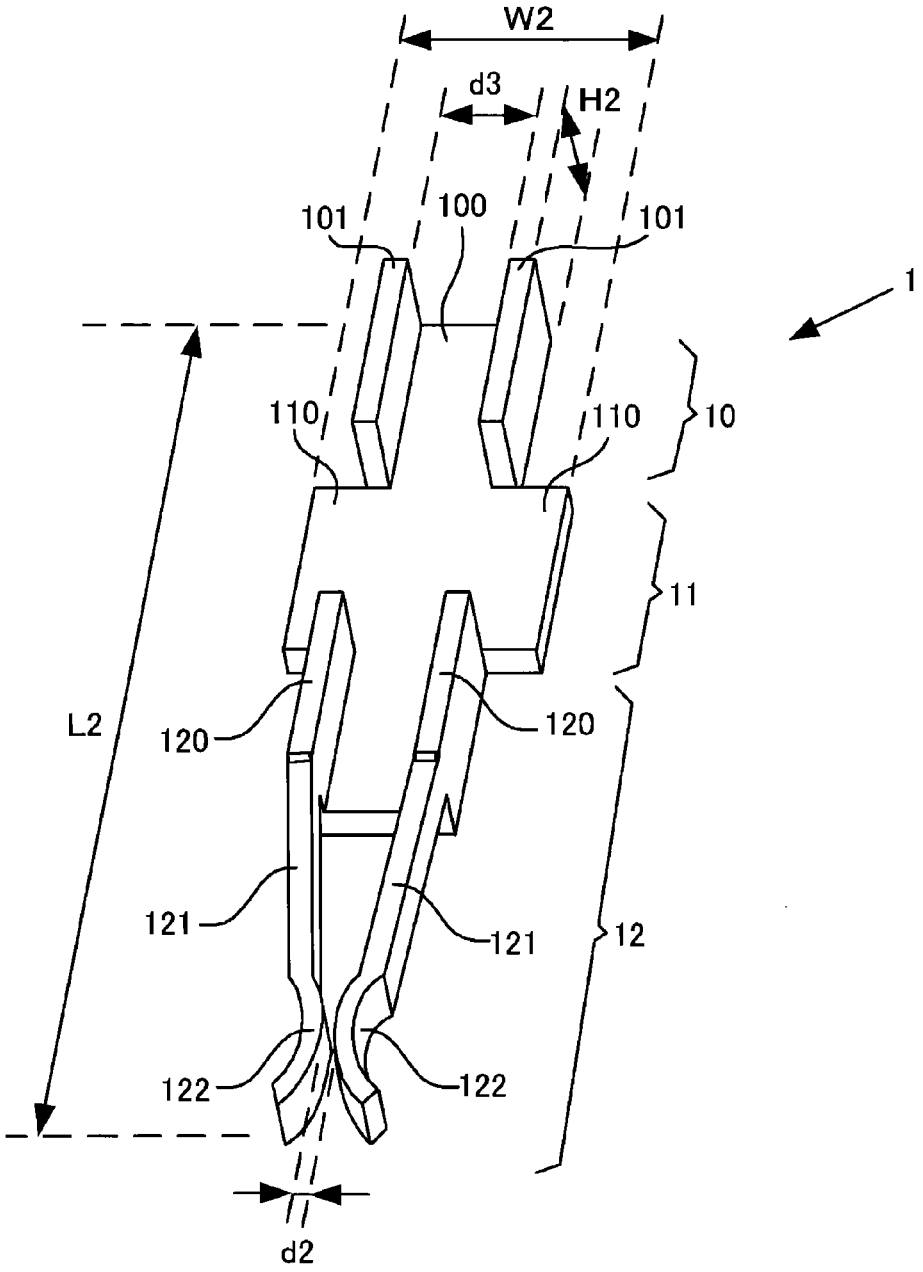
FIG. 2 is a perspective view of a first contact.

FIG. 2 is a perspective view of the first contact 1. The first contact 1 has a longitudinal shape of a length L2, and includes a cable connection part 10, a fixed part 11 and a connector connection part 12. The length L2 is 3.5 mm, for example. In the following description, an end of the connector connection part 12 in a length direction is expressed as "a front edge", and an end of the cable connection part 10 in the length direction is expressed as "a rear edge".

The cable connection part 10 is connected to the core wire 41 which is a signal line of the coaxial cable 4. The cable connection part 10 includes a bottom face 100, and a pair of opposed side faces 101 standing from both ends of the bottom face 100, for example. Then, the cable connection part 10 functions as a portion that accepts the core wire 41 of the coaxial cable 4. The shape of the cable connection part 10 is not limited to this, and may be the shape of a tube or a flat plate.

When the first contact 1 is fixed to the connector cover 3, the cable connection part 10 is held in a position protruded from the rear edge of the connector cover 3 so that soldering is easy. A distance d3 between the side faces 101 and a height H2 are decided according to the size of the core wire 41, and are, for example, 0.5 mm and 0.8 mm, respectively.

Figure 3:
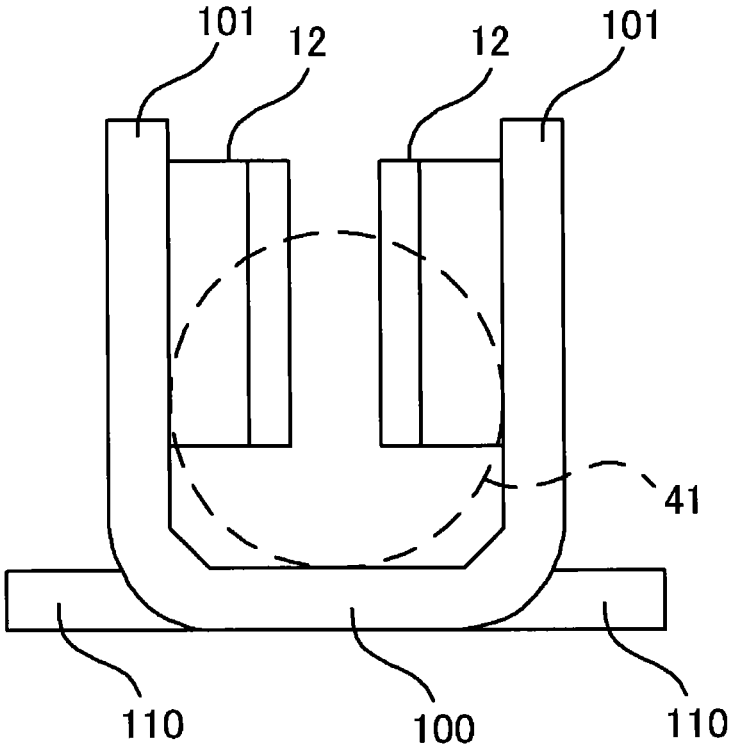
FIG. 3 is a rear view of the first contact.

FIG. 3 is a rear view of the first contact 1. The bottom face 100 and the side faces 101 constitute a horseshoe shape, and have high adhesion with a surface of the core wire 41. Furthermore, in order to improve adhesion, the bottom face 100 and the side faces 101 may have another shape, such as the shape of a semi-circle. Here, in order to align a front edge of the core wire 41, a front edge side of the cable connection part 10 may be provided with an alignment, such as a convex part.

The fixed part 11 illustrated in FIG. 2 is extended toward the front edge from the cable connection part 10, and is fixed to the connector cover 3. Since the fixed part 11 is press-fitted into the connector cover 3, the fixed part 11 has an extended part 110 in which both sides of the bottom face 100 are extended in a width direction, and has the widest width W2 (e.g. 0.97 mm) in the first contact 1. At the time of the press-fit, the extended part 110 is pressed into each of the cut edge parts 34*a* to 34*d* of the connector cover 3 while pressing and extending both sides of the wall parts 30 in a width direction. Therefore, the connector cover 3 may be made of a material with flexibility. As long as the fixed part 11 is connectable to the connector cover 3, the fixed part 11 may not be limited to the shape of a rectangular plate illustrated in FIG. 2 and may have another shape. Although in the present embodiment, a press-fit system is explained as a fixed means, the fixed means is not limited to this but may be a fitting system, for example.

The connector connection part 12 is extended toward the front edge from the fixed part 11, and is connected to a conductor of an exterior connector (i.e., the connection object). For example, the connector connection part 12 pinches an exterior convex conductor. When the connector is connected to a pin of the exterior connector which is the connection object, the connector connection part 12 pinches the connection object to secure electrical connection.

The connector connection part 12 is tabular clip members in which the front edges thereof spread outwardly, for example. The connector connection part 12 includes: a pair of base side walls 120 that are extended from both side ends of the bottom face 100 in the height direction; a pair of arm parts 121 that are extended toward the front edge from the pair of base side walls 120; and a pair of contact parts 122 are extended toward the front edge from the pair of arm parts 121. When the pair of arm parts 121 and the pair of contact parts 122 are press-fitted into the connector cover 3, they are held in each of through-holes 33*a* to 33*d*.

The pair of arm parts 121 extend in the shape of straight lines toward the front edge and have a function of flat springs, so that the arm parts 121 are biased in a direction in which a distance between the arm parts 121 narrows. The pair of contact parts 122 contact the connection object of the connector. The arm parts 121 have arc shapes as viewed from above so that the front edges of the arm parts 121 spread outwardly. Projecting portions of the arcs are spaced by an interval d2 and are opposed to each other. Therefore, the pin of the connection object can easily extend the pair of contact parts 122 outwardly and can contact the pair of contact parts 122. On the contrary, the connector connection part 12 may have a pin shape, and the conductor of the exterior connector of the connection object may have a clip shape. Here, the distance d2 is decided according to the size of the connection object, and is 0.1 mm, for example.

As described above, since the first contact 1 has the cable connection part 10 connected to the core wire 41 of the coaxial cable 4, soldering with the core wire 41 is easy. Since the first contact 1 has the fixed part 11 to be fixed to the exterior connector cover 3, the assembly work of the connector is simplified. Moreover, since the first contact 1 has the connector connection part 12 to be connected to the conductor of the exterior connector, the first contact 1 is connected to the pin which is the connection object of the connector, without using another connection member.

Then, in the first contact 1, the cable connection part 10, the fixed part 11 and the connector connection part 12 are extended according to this order, so that a conductive path from the conductor of the exterior connector as the connection object to the core wire 41 of the coaxial cable 4 is secured. Therefore, a characteristic impedance of a connection part between the first contact 1 and the coaxial cable 4 is easily matched with a characteristic impedance of a connection part between the first contact 1 and the conductor of the exterior connector, and the manufacture of the first contact 1 is easy.

Figure 4:
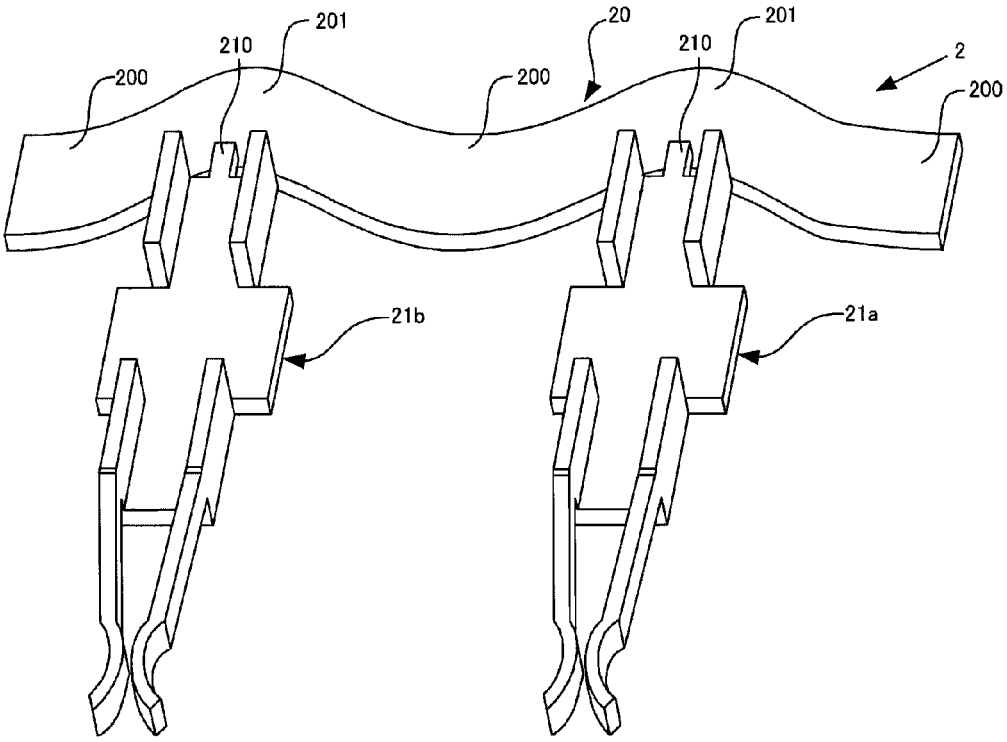
FIG. 4 is a perspective view of a second contact.

FIG. 4 is a perspective view of a second contact 2. The second contact 2 includes a plate-like shield connection part 20, and main units 21*a* and 21*b*. Each of the main units 21*a* and 21*b* is held in the connector cover 3, and is the same as the above-mentioned first contact 1. Each of the main units 21*a* and 21*b* is connected to the shield connection part 20 via a convex coupling part 210 extending toward a rear edge side from the above-mentioned bottom face 100.

The shield connection part 20 is connected at the rear edge side of the cable connection part 10, and contacts the outer peripheral shield part 42 of the coaxial cable 4. The shield connection part 20 is formed in the shape of a board, and extends in a direction perpendicular to a direction in which the cable connection part 10, the fixed part 11 and the connector connection part 12 are arranged. The present embodiment is not limited to a case where plural sets of cable connection parts 10, fixed parts 11 and connector connection parts 12, i.e., plural main units 21*a* and 21*b* are provided on the single shield connection part 20, and a single main unit may be provided on the shield connection part 20. The shield connection part 20 may be integrally molded with at least one main unit 21*a* or 21*b*.

Figure 5:
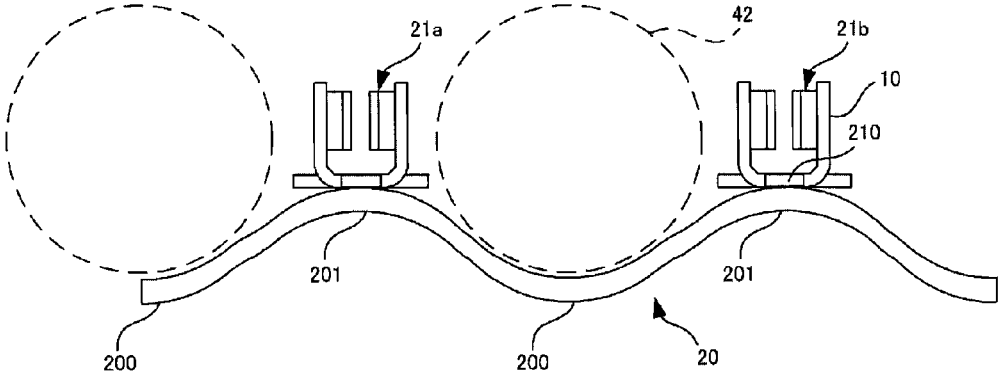
FIG. 5 is a rear view of the second contact.

FIG. 5 is a rear view of the second contact 2. The shield connection part 20 contacts the outer peripheral shield part 42 of the coaxial cable 4, curves so as to draw the shape of a waveform in an extending direction, and accepts the outer peripheral shield part 42 along the curve at a position shifted from the cable connection part 10. Specifically, a mountain part 201 and a valley part 200 that project upward and downward in the height direction, respectively, are alternately formed in the shield connection part 20. The mountain part 201 of the shield connection part 20 is connected to the cable connection part 10, and the valley part 200 of the shield connection part 20 accepts the outer peripheral shield part 42.

In order to improve adhesion, the valley part 200 may be formed according to the shape of the outer periphery of the outer peripheral shield part 42. A distance between the mountain part 201 and the valley part 200 may be decided according to a distance between adjacent through-holes (33*a* and 33*b*, 33*b* and 33*c*, or 33*c* and 33*d*) or adjacent cut edge parts (34*a* and 34*b*, 34*b* and 34*c*, or 34*c* and 34*d*) of the connector cover 3 so that the main units 21*a* and 21*b* of the second contact 2 are easily inserted into the connector cover 3.

Since the second contact 2 includes the construction of the first contact 1, the second contact 2 obtains the above-mentioned effects of the first contact 1. Moreover, since the shield connection part 20 of the second contact 2 is a plate-like member, the manufacture of the second contact 2 is easy, as is the case with the first contact 1.

Figure 6:
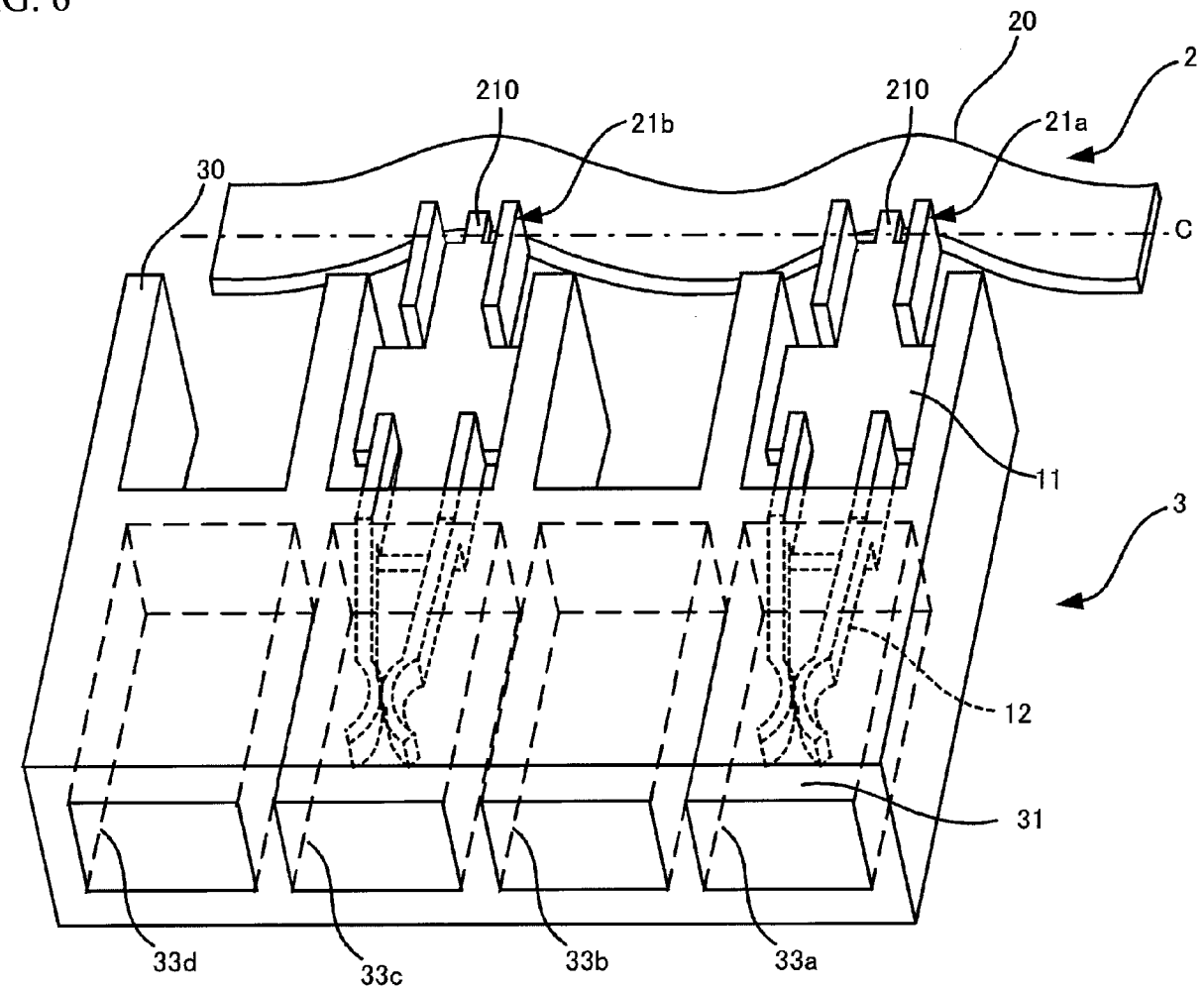
FIG. 6 is a perspective view illustrating an assembling process (i.e., a first mounting process) of the connector according to the first embodiment.

Next, a description is given of a method for manufacturing the connector according to the present embodiment. In a first mounting process illustrated in FIG. 6, the second contact 2 is fixed to the connector cover 3 by the fixed parts 11 so that the connector connection parts 12 are held in the through-holes 33*a* and 33*c* arranged in the connector cover 3. At this time, the fixed parts 11 extend the wall parts 30, and are press-fitted into the cut edge parts 34*a* and 34*c*. Thereby, the connector connection part 12 of the main unit 21*a* is held in the through-hole 33*a*, and the connector connection part 12 of the main unit 21*b* is held in the through-hole 33*c* adjacent to the through-hole 33*b*.

Figure 7:
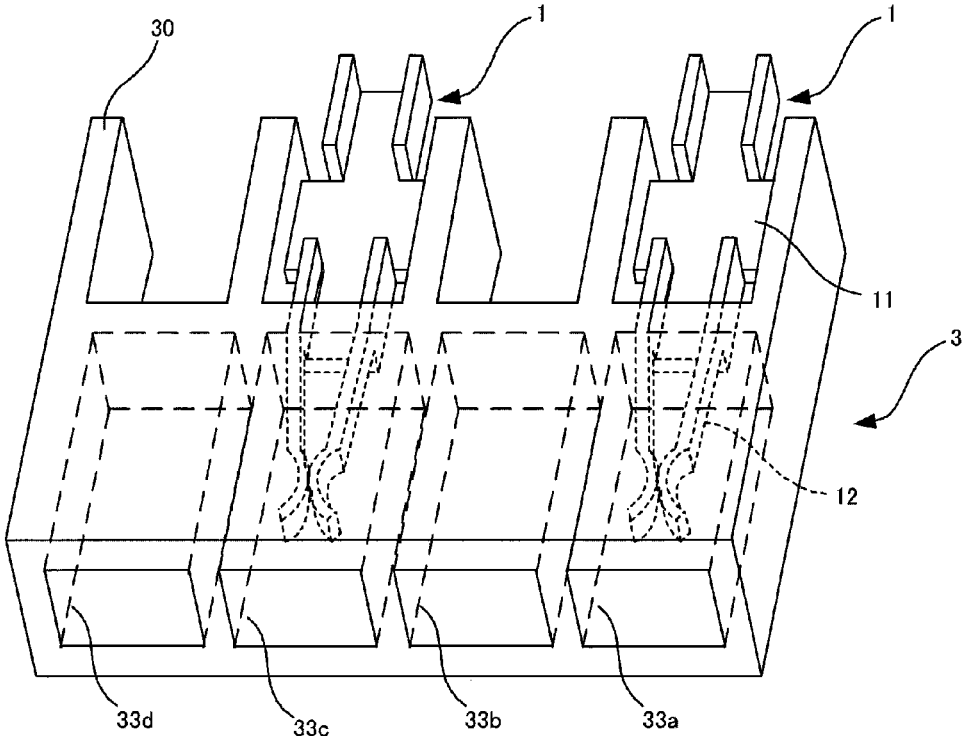
FIG. 7 is a perspective view illustrating an assembling process (i.e., a removal process) of the connector according to the first embodiment.

Next, in a removal process, the shield connection part 20 of the fixed second contact 2 is removed. In the removal process, the coupling parts 210 are cut off along a line C in FIG. 6 with a cutter, such as a nipper, and the shield connection part 20 is separated from the main units 21*a* and 21*b* , for example. Thereby, the main units 21*a* and 21*b* are processed like the first contact 1, as illustrated in FIG. 7.

Figure 8:
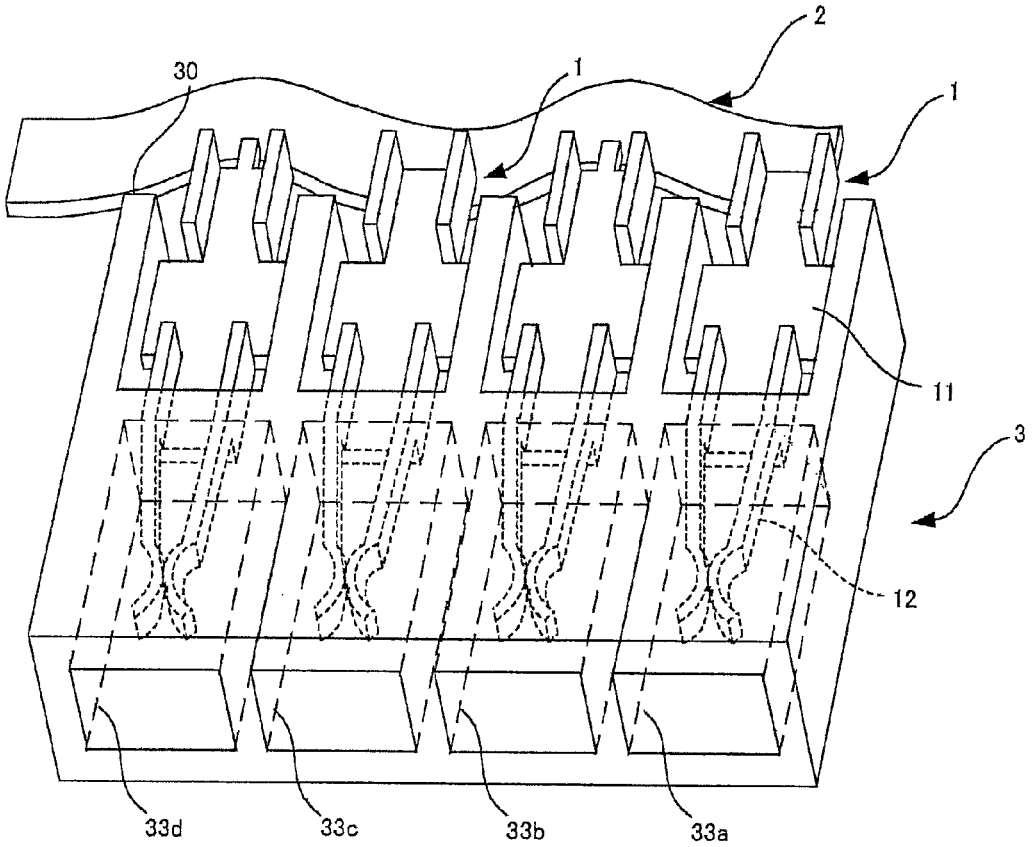
FIG. 8 is a perspective view illustrating an assembling process (i.e., a second mounting process) of the connector according to the first embodiment.

Next, in a second mounting process illustrated in FIG. 8, another second contact 2 is fixed to the connector cover 3 by the fixed parts 11 so that the connector connection parts 12 are held in the through-holes 33*b* and 33*d* among the through-holes 33*a* to 33*d*. Thereby, the connector connection part 12 of the main unit 21*a* is held in the through-hole 33*b*, and the connector connection part 12 of the main unit 21*b* is held in the through-hole 33*d* adjacent to the through-hole 33*c*.

Figure 9:
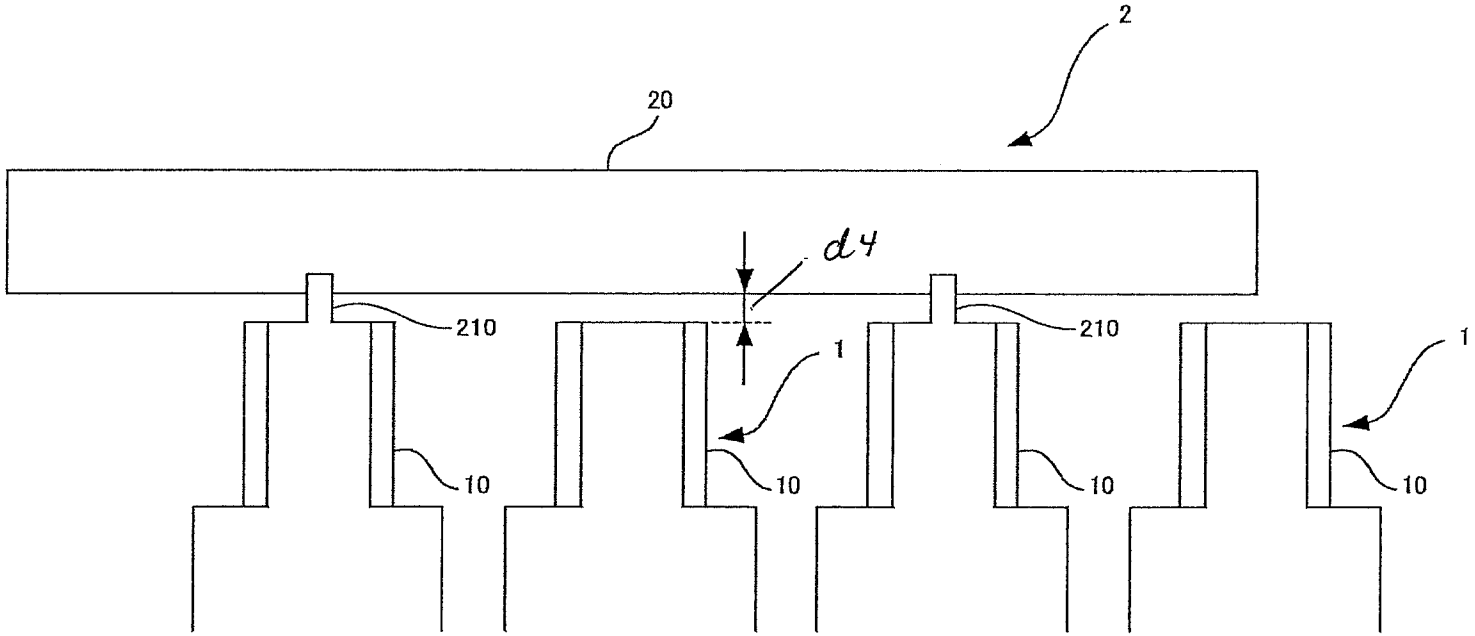
FIG. 9 is a partial top view of the connector illustrated in FIG. 8.

FIG. 9 is a partial top view of the connector illustrated in FIG. 8. Rear edges of the cable connection parts 10 of the first contacts 1 are away from the shield connection part 20 of the second contact 2 by an interval d4 so that the first contacts 1 in which the connector connection parts 12 are held in the through-holes 33*a* and 33*c* is electrically separated from the second contact 2 in which the connector connection parts 12 are held in the through-holes 33*b* and 33*d* . This is because the first contacts 1 to be connected to the core wires 41 of the coaxial cables 4 are insulated from the second contact 2 to be connected to the outer peripheral shield part 42. The interval d4 is 0.5 mm, for example.

The connector of the first embodiment is obtained by the processes described above. According to the manufacturing method, the connector can be assembled easily by the effects of the first contacts 1 and the second contact 2 described above.

Figure 10:
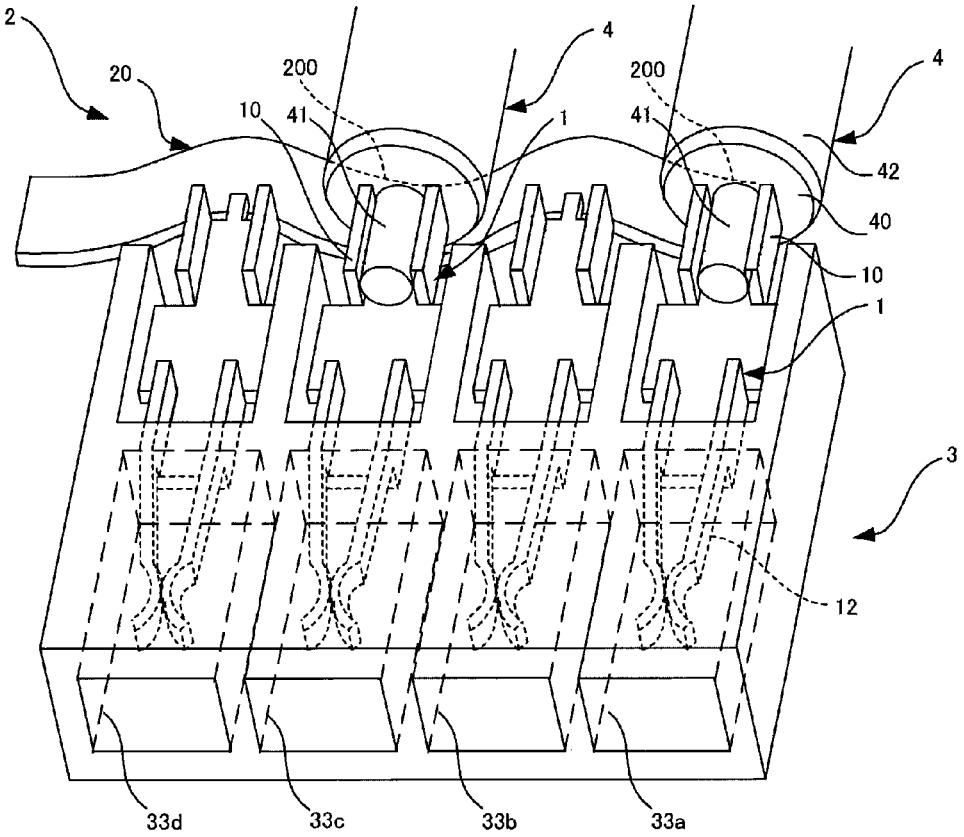
FIG. 10 is a perspective view illustrating a connection condition of the connector and the coaxial cable according to the first embodiment.

FIG. 10 is a perspective view illustrating a connection condition of the connector and the coaxial cable 4 according to the first embodiment. The core wires 41 of the coaxial cables 4 are accepted by the cable connection parts 10 of the first contacts 1 and are soldered to the cable connection parts 10. On the contrary, the outer peripheral shield parts 42 are accepted by the valley parts 200 of the shield connection part 20 of the second contact 2 and are soldered to the valley parts 200. Therefore, the shield connection part 20 is connected to the rear edge side of the cable connection part 10 of one or more first contact 1 to be connected to a ground of the exterior connector. The positions in the width direction of the cable connection part 10 and the valley part 200 can be identical with each other by adjusting the distance between the adjacent through-holes (33*a* and 33*b*, 33*b* and 33*c*, or 33*c* and 33*d*) or the distance between the mountain part 201 and the valley part 200. Therefore, the cable connection part 10 and the valley part 200 are soldered simultaneously and easily.

In this connector, the first contacts 1 are fixed to the connector cover 3 by the fixed parts 11 so that the connector connection parts 12 are held in the through-holes 33*a* and 33*c* . On the contrary, the second contact 2 is fixed to the connector cover 3 by the fixed parts 11 so that the connector connection parts 12 are held in the through-holes 33*b* and 33*d* . The through-holes 33*a* and 33*c* for holding the connector connection parts 12 of the first contacts 1, and the through-holes 33*b* and 33*d* for holding the connector connection parts 12 of the second contact 2 are adjacent to each other. That is, the first contact 1 to be connected to the ground of the exterior connector, and the first contact 1 to be connected to the signal line are adjacent to each other.

The connector of the first embodiment is obtained by the processes described above. According to the manufacturing method, the connector can be assembled easily by the effects of the first contacts 1 and the second contact 2 described above.

The connector is connected to coaxial cable 4, so that a coaxial cable with the connector that alternately assigns a signal flowing through the core wire 41 and a ground potential of the outer peripheral shield part 42 to the through-holes 33*a* to 33*d* can be obtained. Thus, the signal and the ground potential are arranged so as to adjoin each other, so that an electrical characteristic is stabilized and impedance matching becomes easy.

Figure 11:
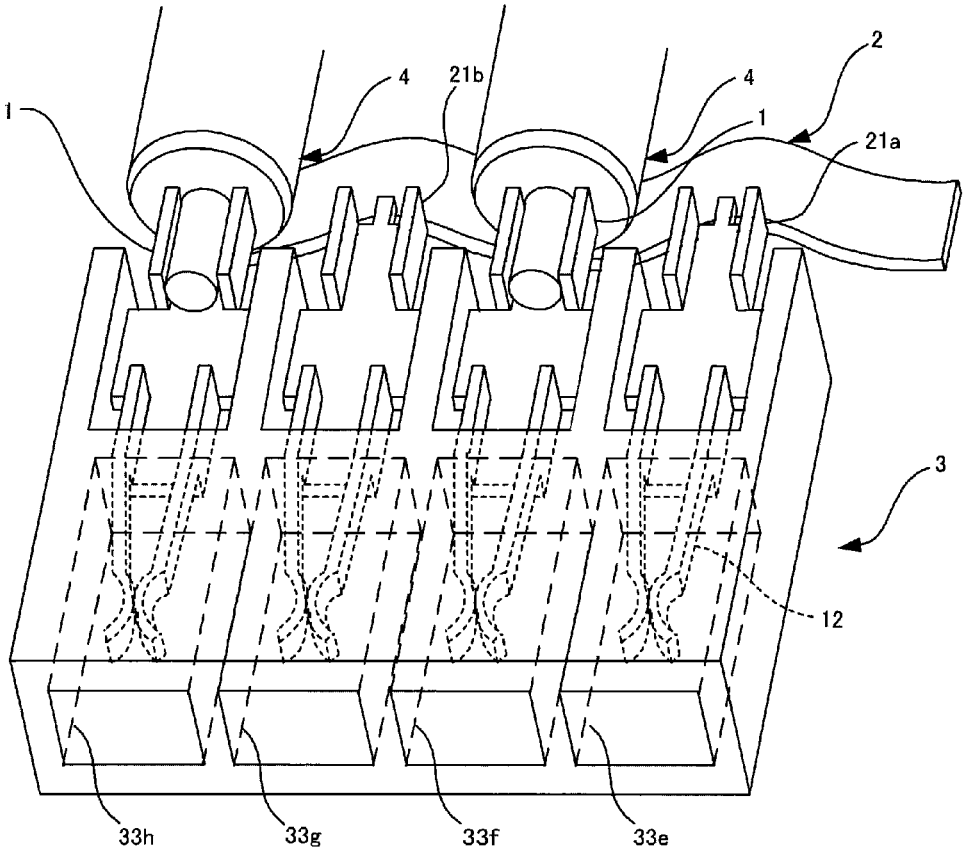
FIG. 11 is a perspective diagram of a connector according to a second embodiment in which assignment of the signals differs from assignment of the signals of FIG. 10.

(Second Embodiment) FIG. 11 illustrates a connector in which assignment of the signal and the ground potential differs from assignment of the signal and the ground potential of FIG. 10. The through-holes 33*e* to 33*h* arranged in a line in FIG. 11 correspond to the through-holes 33*a* to 33*d* in FIG. 10. In the through-holes 33*e* to 33*h* of the connector cover 3, the through-holes 33*e* and 33*g* hold the connector connection parts 12 of the second contact 2, and the through-holes 33*f* and 33*h* hold the connector connection parts 12 of the first contacts 1. In this connector, the assignment of the signal and the ground potential is reversed, compared with the connector illustrated in FIG. 10.

Figure 12:
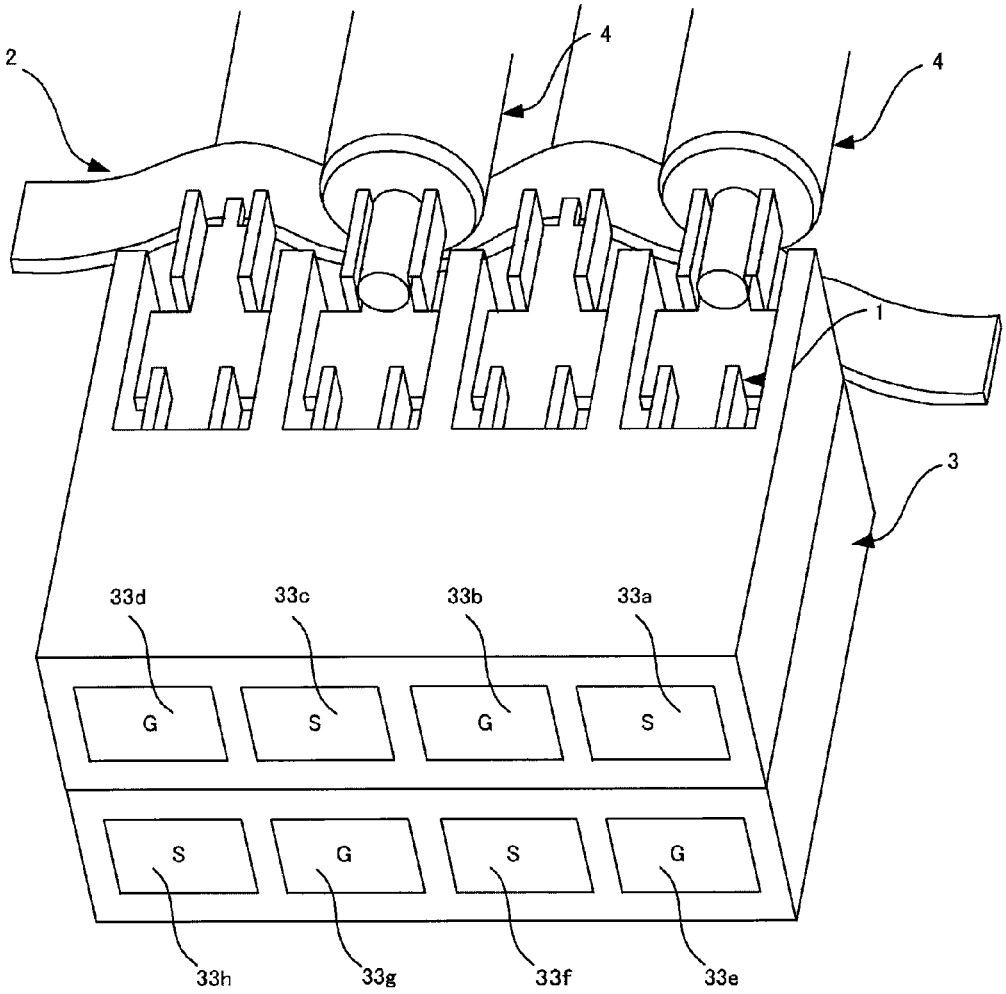
FIG. 12 is a perspective view of the connector according to the second embodiment.

FIG. 12 illustrates the connector of the second embodiment configured such that the connectors illustrated in FIGS. 10 and 11 are stacked as stack members. With respect to the through-holes 33*a* to 33*h* arranged in two lines, codes "S" and "G" in FIG. 12 indicate the assignment of the above-mentioned signal and the above-mentioned ground potential, respectively. In the connector, the signal and the ground potential are assigned to the through-holes 33*a* to 33*h* so as to be adjacent to each other in the width and the height directions. That is, in the contacts arranged in two lines, one contact 1 that is arranged in one line and connected to the ground of the exterior connector (i.e., connection object), and another contact 1 that is arranged in another line and connected to the signal line of the exterior connector are adjacent to each other.

The connector illustrated in FIG. 10 and the connector illustrated in FIG. 11 are mutually connected at the bottom board part 32 of the connector in FIG. 10 and the top board part 31 of the connector in FIG. 11. Therefore, it is desirable that a concave part and a convex part are provided on the surfaces of the top board part 31 and the bottom board part 32, and each of the concave part and the convex part serves as an alignment for mutually aligning the top board part 31 and the bottom board part 32 or a fitting for mutually fixing the top board part 31 and the bottom board part 32. The connector illustrated in FIG. 10 and the connector illustrated in FIG. 11 may be pasted by an adherent such as adhesion materials without using the concave part and the convex part.

Figure 13:
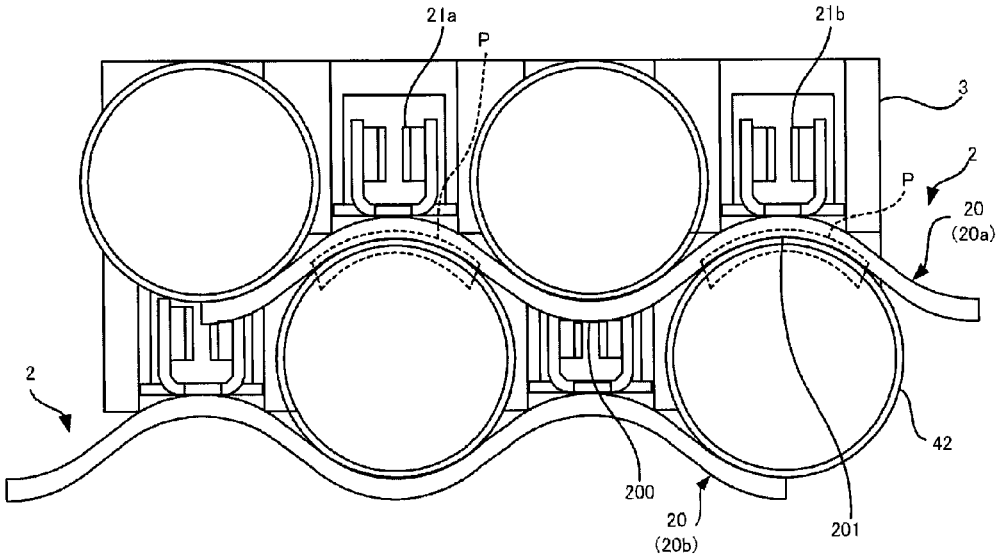
FIG. 13 is a rear view of the connector according to the second embodiment.

FIG. 13 is a rear view of the connector according to the second embodiment. In the two lines in which the through-holes 33*a* to 33*h* are arranged, the shield connection part 20 (20*a*) of the second contact 2 in which the connector connection parts 12 are held in the through-holes 33*b* and 33*d* of an upper line contacts along the curves the outer peripheral shield parts 42 accepted by the shield connection part 20 (20*b*) of the second contact 2 in which the connector connection parts 12 are held in the through-holes 33*e* and 33*g* of a lower line (see code "P" in FIG. 13). That is, the mountain parts 201 of the upper connector contact the outer peripheral shield parts 42 of the coaxial cables 4 connected to the lower connector. That is to say, the shield connection part 20 (20*a*) that is connected to the contacts 2 arranged in one line, and the shield connection part 20 (20*b*) that is connected to the contacts 2 arranged in another line accept the outer peripheral shield parts 42 along the respective curves.

Therefore, it is desirable that each mountain part 201 of the shield connection part 20 is formed according to the shape of the surface of the outer peripheral shield part 42, as is the case with the valley part 200. Thus, by connecting more outer peripheral shield parts 42 to the shield connection part 20, the ground potential is stabilized and the consistency of characteristic impedances improves.

Figure 14:
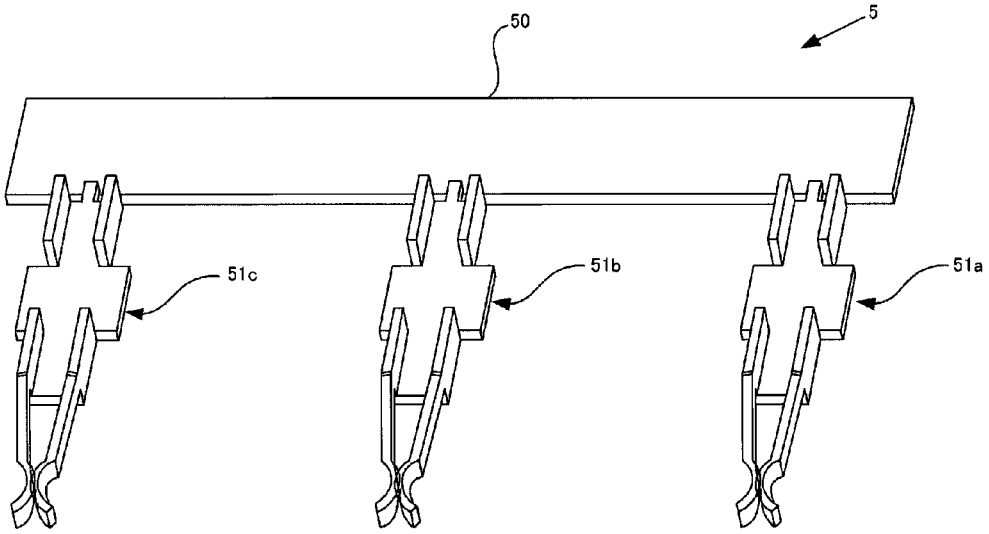
FIG. 14 is a perspective view illustrating another example of the second contact.

(Third Embodiment) A third embodiment illustrates an example of a connector that is applied to a twin-coaxial cable as a substitute for the coaxial cable 4 described above. FIG. 14 is a perspective view illustrating a second contact 5 used for the third embodiment. The second contact 5 includes a shield connection part 50 and three main units 51*a* to 51*c* . Each of three main units 51 a to 51 c is the same member as the first contact 1 illustrated in FIG. 2, and connected to the shield connection part 50, as is the case with the previous embodiments. The shield connection part 50 is a plate-like member having a flat surface, unlike the previous embodiments.

Figure 15:
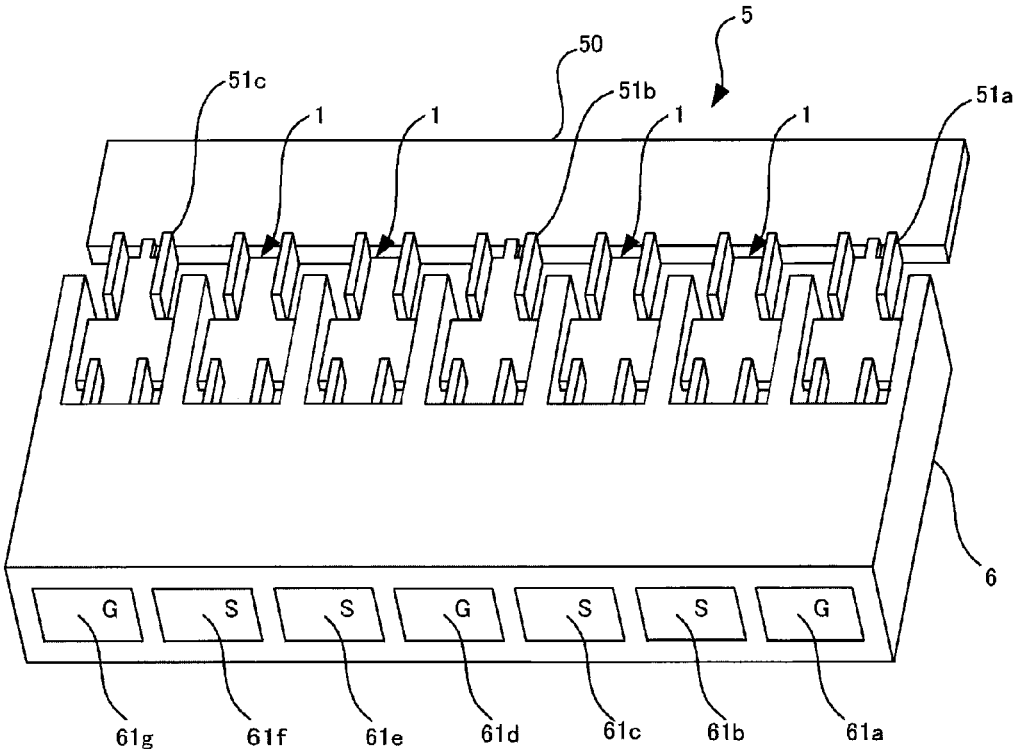
FIG. 15 is a perspective view of the connector according to a third embodiment.

FIG. 15 is a perspective view of the connector according to the third embodiment. The connector is obtained by a process for fixing the second contact 5 to a connector cover 6 by the fixed parts 11 and a process for removing the shield connection part 50 of press-fitted second contact 5, as is the case with the manufacturing method of the above-mentioned connector.

In the connector cover 6, the number of through-holes 61*a* to 61*g* is different from the number of through-holes of the previous embodiments. The through-holes 61*a* to 61*g* are arranged in a line. The connector connection parts 12 of the main units 51*a* to 51*c* of the second contact 5 are held in the through-holes 61*a*, 61*d* and 61*g*, respectively. The connector connection parts 12 of the first contacts 1 obtained by the above-mentioned removal process are held in the through-holes 61*b*, 61*c*, 61*e* and 61*f*.

Figure 16:
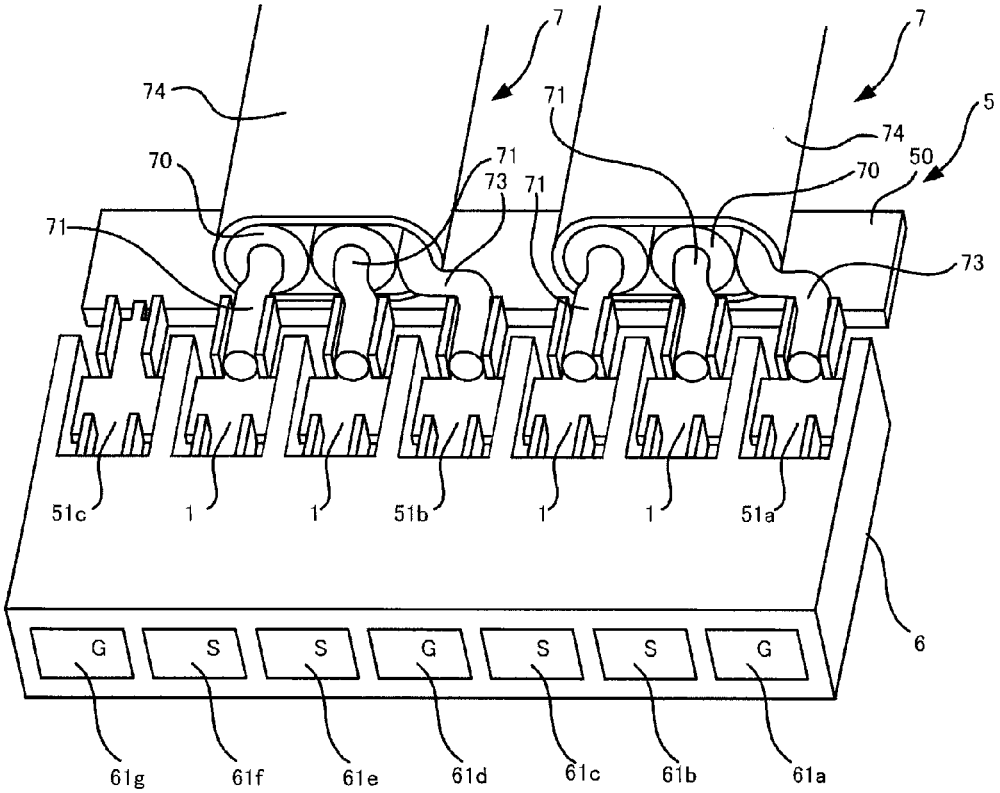
FIG. 16 is a perspective view illustrating a connection condition of the connector and twin-coaxial cables according to the third embodiment.

FIG. 16 is a perspective view illustrating a connection condition of the connector and twin-coaxial cables 7 according to the third embodiment. The connector of the third embodiment is connected to two twin-coaxial cables 7. Each of two twin-coaxial cables 7 includes: two core wires 71; two insulators 70 that are provided around the core wires 71 and adjacent to each other; a drain wire 73 adjacent to one insulator 70; and an outer peripheral shield part 74 that covers the peripheries of the insulators 70 and the drain wire 73. Each of the core wires 71 functions as a signal line transmitting a signal.

The outer peripheral shield part 74 has a flat surface extending in the width direction, and is soldered to the shield connection part 50 via the flat surface. The core wires 71 are accepted by the cable connection parts 10 of the first contacts 1 in the through-holes 61*b*, 61*c*, 61*e* and 61*f*, and soldered to the cable connection parts 10.

On the contrary, the drain wires 73 are accepted by the cable connection parts 10 in the through-holes 61*a* and 61*d*, and soldered to the cable connection parts 10. Each of the core wires 71 and the drain wires 73 is bent to compensate a positional difference between each of the core wires 71 and the drain wires 73, and each of corresponding cable connection parts 10. Since the drain wire 73 contacts the outer peripheral shield part 74, the drain wire 73 has the ground potential.

When it is assumed that each of the through-holes 61*b*, 61*c*, 61*e* and 61*f* that holds the connector connection part 12 of the first contact 1 is set as a first hole, and each of the through-holes 61*a*, 61*d* and 61*g* that holds the connector connection part 12 of the second contact 5 is set as a second hole, the through-holes 61*a* to 61*g* are arranged in order of the second hole, the first hole and the first hole. That is, in this connector, the assignment of terminals is performed based on a pattern of the ground potential, the signal, and the signal, as seen in the example of the codes "S" and "G" in FIG. 16. Thereby, the transmission of differential signals, such as LVDS (Low Voltage Differential Signaling), is realized.

Figure 17:
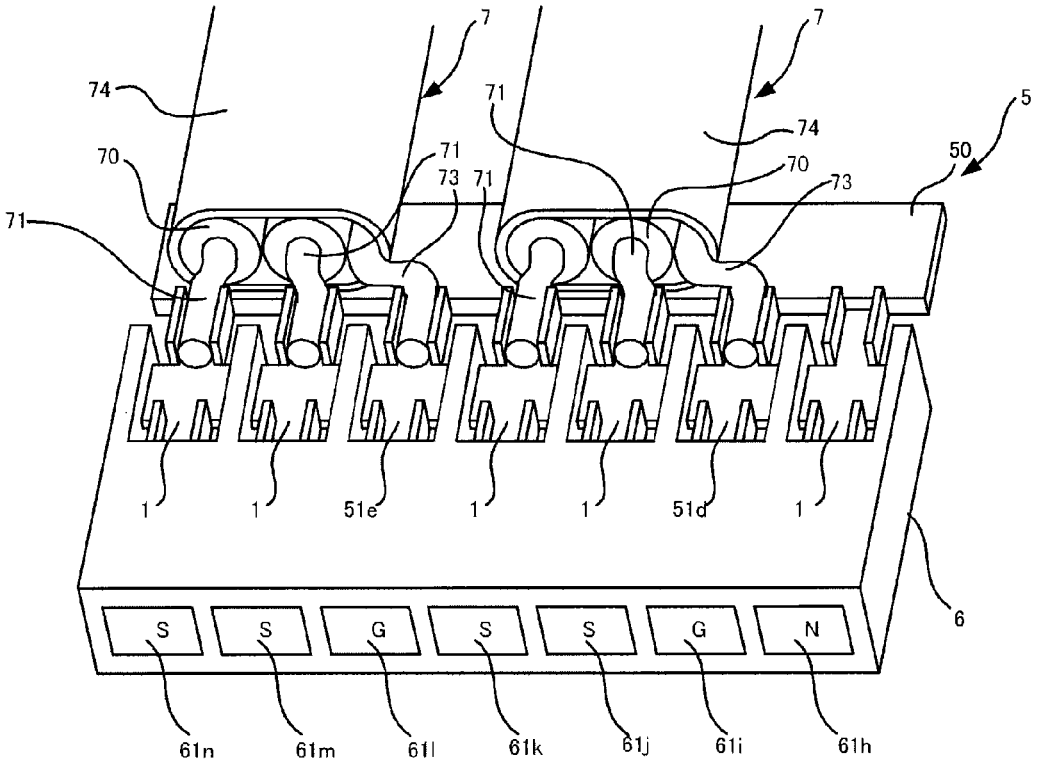
FIG. 17 is a perspective diagram of the connector according to the third embodiment in which assignment of the signals differs from assignment of the signals of FIG. 16.

(Fourth Embodiment) FIG. 17 illustrates a connector in which the assignment of the signals and the ground potential differs from the assignment of the signals and ground potential of FIG. 16. Through-holes 61*h* to 61*n* arranged in a line in FIG. 17 correspond to the through-holes 61*a* to 61*g* of FIG. 16. In the connector, the through-holes 61*i* and 61*i* of the connector cover 6 hold the connector connection parts 12 of the main units 51*d* and 51*e*, respectively, of the second contact 5, and the through-holes 61*h* , 61*j* , 61*k*, 61*m* and 61*n* of the connector cover 6 hold the connector connection parts 12 of the first contacts 1. That is, the assignment of the signals and the ground potential in the connector is shifted by one terminal in the width direction, compared with the connector of FIG. 16. Here, since the twin- coaxial cable 7 is not connected to the through-hole 61*h* , a signal is not assigned to the connector connection part 12 in the through-hole 61*h* (see a code "N").

Figure 18:
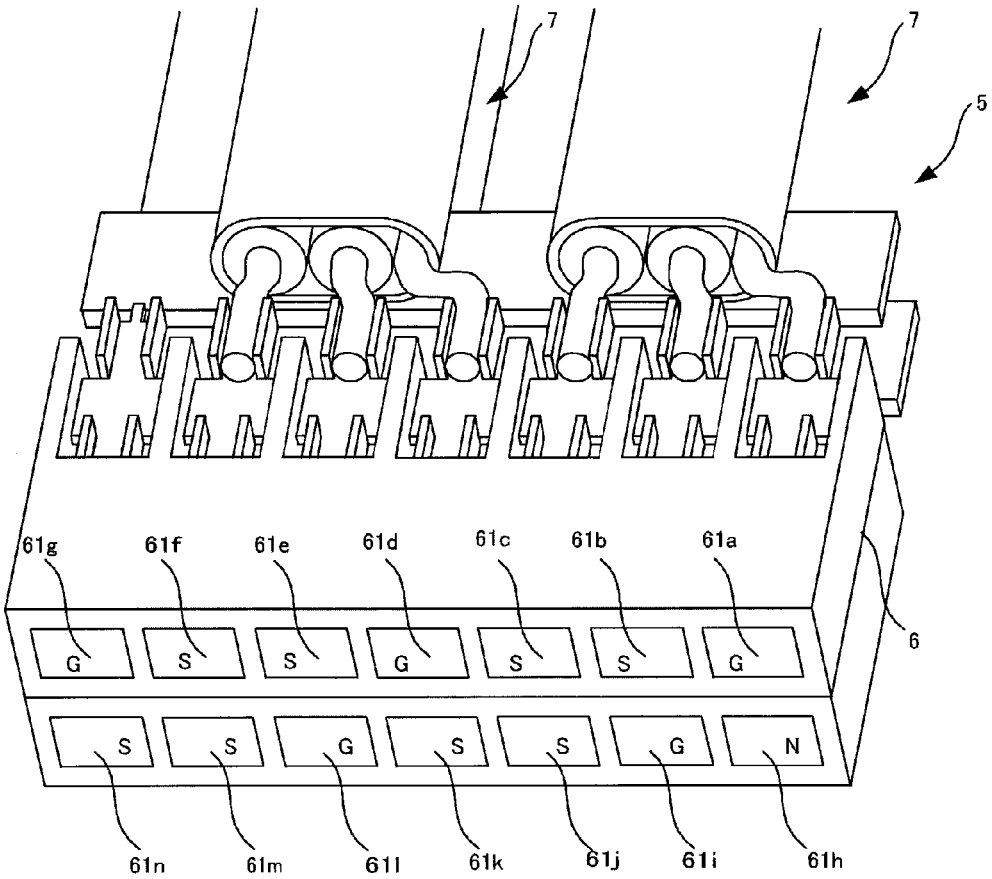
FIG. 18 is a perspective view of the connector according to a fourth embodiment.

FIG. 18 illustrates the connector of the fourth embodiment configured such that the connectors illustrated in FIGS. 16 and 17 are stacked as stack members. A method for stacking the connectors as the stack members is the same as that of the second embodiment. With respect to the through-holes 61*a* to 61*n* arranged in two lines, the codes "S" and "G" in FIG. 18 indicate the assignment of the above-mentioned signal and the above-mentioned ground potential, respectively. In the through-holes 61*a* to 61*n* of the connector arranged in two lines, the second hole, the first hole and the first hole arranged in one line are adjacent to the first hole, the second hole and the first hole arranged in another line, respectively.

Figure 19:
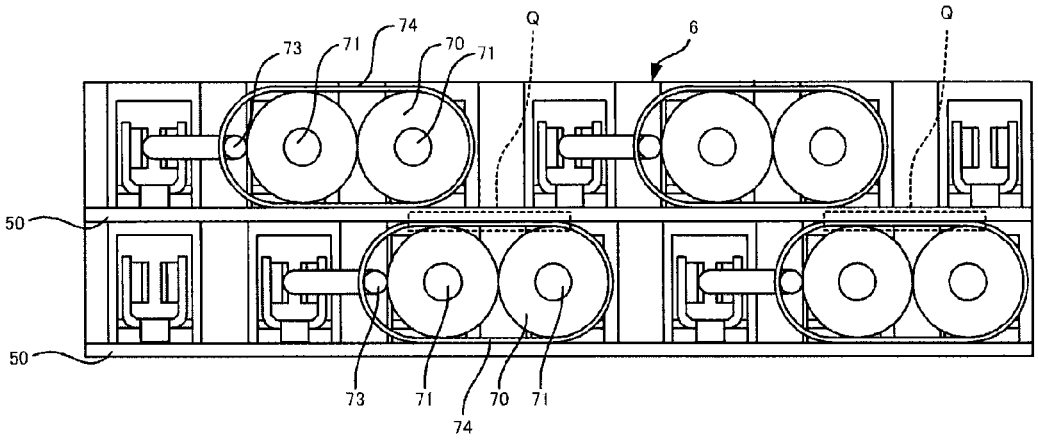
FIG. 19 is a rear view of the connector according to the fourth embodiment.

FIG. 19 is a rear view of the connector according to the fourth embodiment. As is the case with the second embodiment, the shield connection part 50 of the second contact 5 of an upper line among the two lines in which the through-holes 61*a* to 61*n* are arranged contacts the outer peripheral shield parts 74 accepted by the shield connection part 50 of the second contact 5 of a lower line (see codes "Q" in FIG. 19). Therefore, the same effects as those in the above described embodiments can be obtained.

Figure 20:
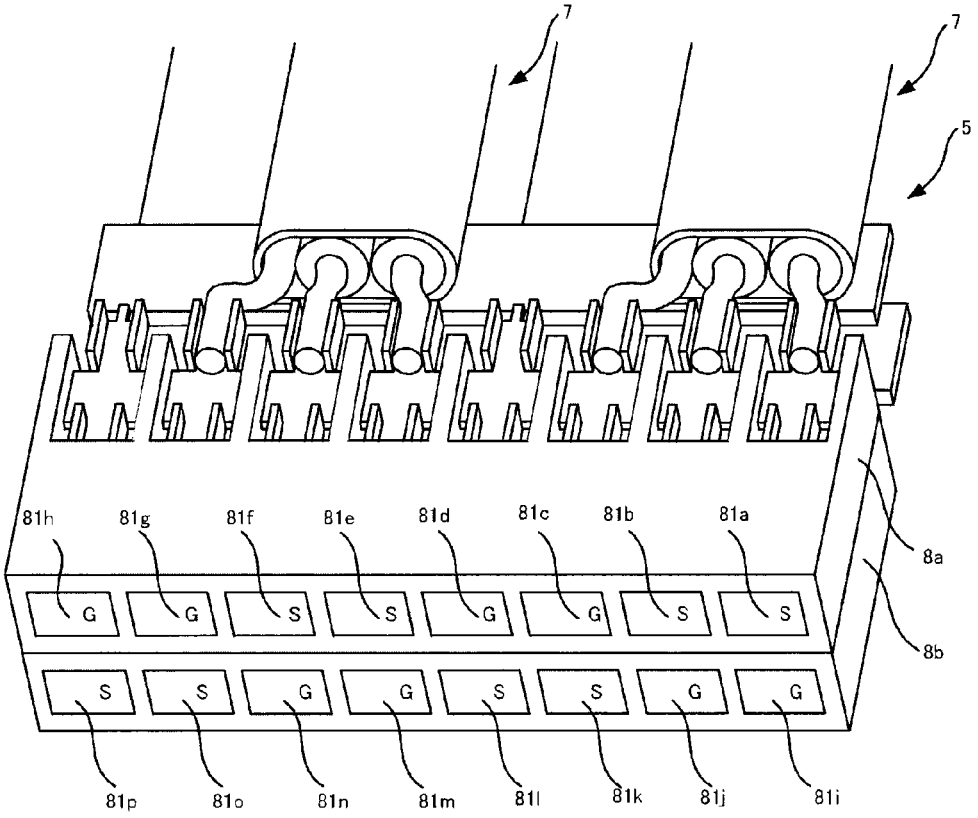
FIG. 20 is a perspective view of the connector according to a fifth embodiment.

(Fifth Embodiment) FIG. 20 illustrates a connector configured such that an upper connector cover 8*a* having in-line through-holes 81*a* to 81*h* and a lower connector cover 8*b* having in-line through-holes 81*i* to 81*p* are stacked as stack members. In each of the upper connector cover 8a and the lower connector cover 8b, the first contacts 1 and the second contact 5 are press-fitted by the above-mentioned manufacturing method. Then, each of the shield connection parts 50 of the second contacts 5 is connected to the two twin-coaxial cables 7. Here, the second contact 5 of the fifth embodiment includes four main units. A connection direction of the twin-coaxial cable 7 in the width direction is opposite to that of the twin-coaxial cable 7 of the fourth embodiment.

When it is assumed that each of through-holes 81*a*, 81*b*, 81*e*, 81*f*, 81*k*, 81*l*, 81*o* and 81*p* in upper and lower lines that holds the connector connection part 12 of the first contact 1 is set as the first hole, and each of through-holes 81*c*, 81*d*, 81*g*, 81*h*, 81*i*, 81*j*, 81*m* and 81*n* in upper and lower lines that holds the connector connection part 12 of the second contact 5 is set as the second hole, the through-holes 81*a* to 81*h* and 81*i* to 81*p* of this connector are arranged in order of the second hole, the second hole, the first hole and the first hole. Moreover, in the through-holes 81*a* to 81*p* arranged in the two lines, the second hole, the second hole, the first hole and the first hole arranged in one line are adjacent to the first hole, the first hole, the second hole and the second hole arranged in another line, respectively. Thereby, the same effects as those in the above described embodiments can be obtained.

As described above, the second contact 2 or 5 is used and the connector covers 3, 6, 8*a* or 8*b* are stacked as the stack members, so that a connector having various pin configuration can be easily obtained. There is no limitation in the number of main units, i.e., the same member as the first contact 1 in the second contact 2 or 5. As long as the connector cover 3, 6, 8*a* or 8*b* has a shape in which the fixed part 11 of the contact 1, 2 or 5 can be press-fitted and the connector connection part 12 can be held, there is no limitation in the shape of the connector cover 3, 6, 8*a* or 8*b*.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority and inferiority of the invention. Although the embodiments of the present invention have been described in detail, it should be understood that the various change, substitutions, and alterations could be made hereto without departing from the spirit and scope of the invention.

What is claimed is:

1. A connector comprising:

a connector cover;

a plurality of contacts, including a signal contact and a ground contact, fixed to the connector cover; and a shield connection portion that has a curve, contacts an outer peripheral shield of an exterior cable, and is separated from the signal contact;

wherein the signal contact includes:

a cable connection portion that is connected to a signal line in the exterior cable;

a fixed portion that is extended toward a front edge of the signal contact from the cable connection portion, and fixed to the connector cover; and a connector connection portion that is extended toward the front edge of the signal contact from the fixed portion, and connected to a conductor of an exterior connector, wherein the shield connection portion is integrally connected to a rear edge of a cable connection portion of the ground contact, wherein the cable connection portion, a fixed portion and a connector connection portion of the ground contact are integrally formed with the shield connection portion, wherein the plurality of contacts are arranged up and down in two lines, wherein the shield connection portion includes a first shield connection portion that is connected to the contacts arranged in one line and a second shield connection portion that is connected to the contacts arranged in another line, and wherein the first shield connection portion and the second shield connection portion receive the outer peripheral shield along the curve, and wherein the shield connection portion has a waveform including mountain parts and valley parts which continue alternately.

2. The connector according to claim 1, wherein the shield connection portion receives the outer peripheral shield along the curve at a position shifted from the cable connection portion of the ground contact.

3. The connector according to claim 1, wherein the signal contact and the ground contact are adjacent to each other.

4. The connector according to claim 1, wherein the fixed portion of the signal contact has a width wider than widths of the cable connection portion and the connector connection portion of the signal contact.

5. A connector comprising:

a connector cover;

a plurality of contacts, including a signal contact and a ground contact, fixed to the connector cover; and a shield connection portion that has a waveform including mountain parts and valley parts which continue alternately, contacts an outer peripheral shield of an exterior cable, and is separated from the signal contact, wherein the signal contact includes:

a cable connection portion that is connected to a signal line in the exterior cable;

a fixed portion that is extended toward a front edge of the signal contact from the cable connection portion, and fixed to the connector cover; and a connector connection portion that is extended toward the front edge of the signal contact from the fixed portion, and connected to a conductor of an exterior connector, wherein the shield connection portion is integrally connected to a rear edge of a cable connection portion of the ground contact, wherein the plurality of contacts are arranged in two lines, wherein a contact that is connected to a ground of the exterior connector and arranged in one line, and a contact that is connected to a signal line of the exterior connector and arranged in another line are adjacent to each other, and wherein the shield connection portion receives the outer peripheral shield along a curve at a position shifted from the cable connection portion of the ground contact.

6. The connector according to claim 5, wherein the fixed portion of the signal contact has a width wider than widths of the cable connection portion and the connector connection portion of the signal contact.

7. A connector comprising:

a connector cover;

a plurality of contacts, including a signal contact and a ground contact, fixed to the connector cover; and a shield connection portion that contacts an outer peripheral shield of an exterior cable, and is separated from the signal contact;

wherein the signal contact includes:

a cable connection portion that is connected to a signal line in the exterior cable;

a fixed portion that is extended toward a front edge of the signal contact from the cable connection portion, and fixed to the connector cover; and a connector connection portion that is extended toward the front edge of the signal contact from the fixed portion, and connected to a conductor of an exterior connector, wherein the shield connection portion is integrally connected to a rear edge of a cable connection portion of the ground contact, wherein the plurality of contacts are arranged in two lines, wherein a contact that is connected to a ground of the exterior connector and arranged in one line, and a contact that is connected to a signal line of the exterior connector and arranged in another line are adjacent to each other, wherein the shield connection portion has a waveform including mountain parts and valley parts which continue alternately, and receives the outer peripheral shield at a position shifted from the cable connection portion of the ground contact.

8. The connector according to claim 7, wherein the fixed portion of the signal contact has a width wider than widths of the cable connection portion and the connector connection portion of the signal contact.

9. A connector comprising:

a connector cover;

a plurality of contacts, including a signal contact and a ground contact, fixed to the connector cover; and a shield connection portion that has a curve, contacts an outer peripheral shield of an exterior cable, and is separated from the signal contact;

wherein the signal contact includes:

a cable connection portion that is connected to a signal line in the exterior cable;

a fixed portion that is extended toward a front edge of the signal contact from the cable connection portion, and fixed to the connector cover; and a connector connection portion that is extended toward the front edge of the signal contact from the fixed portion, and connected to a conductor of an exterior connector, wherein the shield connection portion is integrally connected to a rear edge of a cable connection portion of the ground contact, wherein the cable connection portion, a fixed portion and a connector connection portion of the ground contact are integrally formed with the shield connection portion, wherein the plurality of contacts are arranged up and down in two lines, wherein the shield connection portion includes a first shield connection portion that is connected to the contacts arranged in one line and a second shield connection portion that is connected to the contacts arranged in another line, and wherein the first shield connection portion and the second shield connection portion receive the outer peripheral shield along the curve, and wherein the shield connection portion defines a waveform, and receives the outer peripheral shield along the curve at a position shifted from the cable connection portion of the ground contact.

* * * * *